US006200716B1

(12) United States Patent
Fuller et al.

(10) Patent No.: US 6,200,716 B1
(45) Date of Patent: Mar. 13, 2001

(54) PHOTORECEPTOR WITH POLY (VINYLBENZYL ALCOHOL)

(75) Inventors: Timothy J. Fuller; Huoy-Jen Yuh, both of Pittsford; John S. Chambers, Rochester; Harold F. Hammond, Webster; Damodar M. Pai, Fairport; John F. Yanus, Webster; Markus R. Silvestri, Fairport; Helen R. Cherniack, Rochester, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/440,556

(22) Filed: Nov. 15, 1999

(51) Int. Cl.[7] ..... G03G 5/10
(52) U.S. Cl. ..... 430/64; 430/65
(58) Field of Search ..... 430/58.8, 64, 69, 430/65

(56) References Cited

U.S. PATENT DOCUMENTS

| | | | | |
|---|---|---|---|---|
| 3,879,328 | * | 4/1975 | Jones | 260/29.6 |
| 4,464,450 | | 8/1984 | Teuscher | 430/59 |
| 4,518,669 | | 5/1985 | Yashiki | 430/57 |
| 4,579,801 | | 4/1986 | Yashiki | 430/60 |
| 4,775,605 | | 10/1988 | Seki et al. | 430/63 |
| 5,017,449 | | 5/1991 | Yoshihara | 430/59 |
| 5,279,934 | * | 1/1994 | Smith et al. | 430/539 |
| 5,344,734 | | 9/1994 | Monbaliu et al. | 430/59 |
| 5,385,796 | | 1/1995 | Spiewak et al. | 430/64 |
| 5,449,573 | | 8/1995 | Aoki et al. | 430/131 |
| 5,489,496 | | 2/1996 | Katayama et al. | 430/62 |
| 5,641,599 | | 6/1997 | Markovics et al. | 430/59 |
| 5,656,407 | | 8/1997 | Kawahara | 430/78 |
| 5,721,080 | | 2/1998 | Terrell et al. | 430/58 |
| 5,874,193 | * | 2/1999 | Liu et al. | 430/58.8 |
| 5,928,824 | | 7/1999 | Obinata et al. | 430/62 |

* cited by examiner

*Primary Examiner*—John Goodrow
(74) *Attorney, Agent, or Firm*—Zosan S. Soong

(57) ABSTRACT

A photoreceptor including: (a) a substrate; (b) a charge blocking layer comprising a polymer polymerized fiom at least one monomer including vinylbenzyl alcohol monomer; and (c) at least one imaging layer.

14 Claims, 1 Drawing Sheet

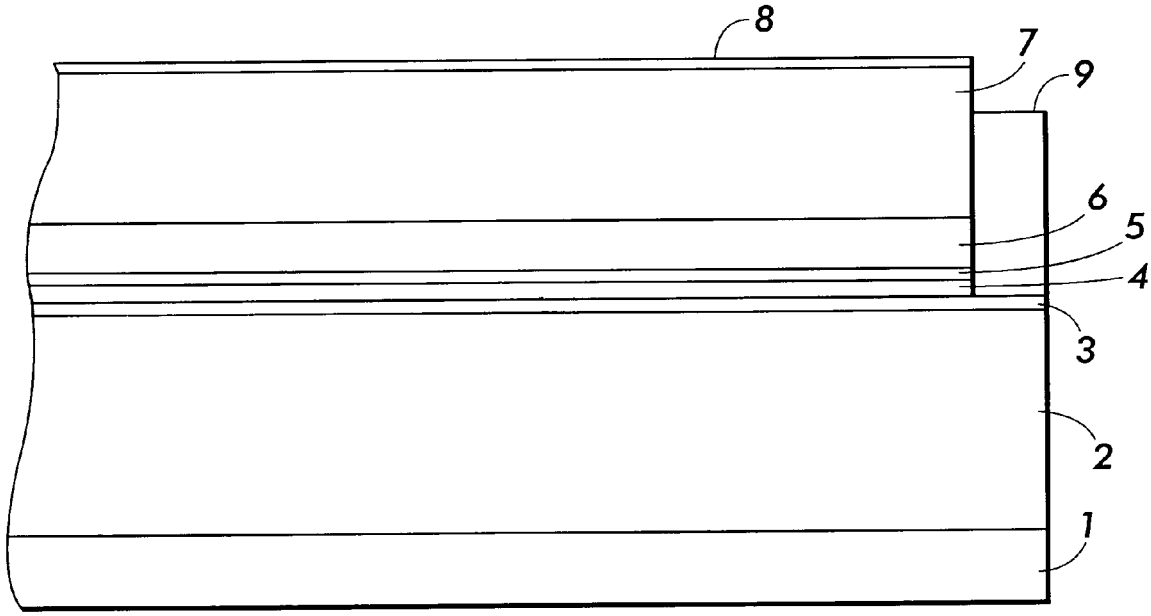
8
7
9
6
5
4
3
2
1

PHOTORECEPTOR WITH POLY (VINYLBENZYL ALCOHOL)

FIELD OF THE INVENTION

This invention is directed to a photoreceptor useful for an electrostatographic printing machine, and more particularly to a blocking layer of a photoreceptor.

BACKGROUND OF THE INVENTION

The demand for improved print quality in xerographic reproduction is increasing, especially with the advent of color. Some of the print quality issues such as the defect level of the charge deficient spots ("CDS") and the print defects caused by bias charge roll ("BCR") leakage, are strongly dependent on the quality of the charge blocking layer. Conventional materials used for the blocking layer have been problematic. In certain situations, a thicker blocking layer is desirable, but the thickness of the material used for the blocking layer is limited by the inefficient transport of the photoinjected electrons from the generator layer to the substrate. Another problem is posed by a blocking layer that is too thin: incomplete coverage of the substrate due to wetting problems on localized unclean substrate surface areas. These pin holes can then produce CDS and BCR leakage breakdown. A thicker blocking layer can be produced by dispersing titanium dioxide particles into a binder, which can allow the transport of photogenerated electrons and may eliminate any pin holes due to incomplete coverage. In certain situations, a high concentration of titanium dioxide in the blocking layer is desirable. However, the dispersion quality such as particle size distribution may be significantly worse at a high titanium dioxide concentration. Poor dispersions often cause coating defects such as streak and coating non-uniformity. The dispersion quality of titanium dioxide depends on the binder and solvent employed. Conventional binders and solvents may be unsuitable at a high concentration of the titanium dioxide. In addition, some conventional binders are soluble in the solutions coated onto the substrate after the blocking layer such as the solutions for the charge generating layer and the charge transport layer. Such a solubility allows intermixing of layers that results in electrical and print quality problems. Thus, there is a need, which the present invention addresses, for new binders for the blocking layer of a photoreceptor that minimize or eliminate the problems of conventional binders described herein.

The phrases "charge blocking layer" and "blocking layer" are generally used interchangeably with the phrase "undercoat layer."

Conventional photoreceptors and their materials are dislosed in Katayama et al., U.S. Pat. No. 5,489,496; Yashiki, U.S. Pat. No. 4,579,801; Yashiki, U.S. Pat. No. 4,518,669; Seki et al., U.S. Pat. No. 4,775,605; Kawahara, U.S. Pat. No. 5,656,407; Markovics et al., U.S. Pat. No. 5,641,599; Monbaliu et al., U.S. Pat. No. 5,344,734; Terrell et al., U.S. Pat. No. 5,721,080; and Yoshihara, U.S. Pat. No. 5,017,449.

Conventional charge blocking layers are also disclosed in U.S. Pat. No. 4,464,450; U.S. Pat. No. 5,449,573; U.S. Pat. No. 5,385,796; and Obinata et al, U.S. Pat. No. 5,928,824.

Poly(vinylbenzyl alcohol) is described in Jones, U.S. Pat. No. 3,879,328.

Copending application, Ser. No. 09/320,869 now U.S. Pat. No. 6,132,912, is directed to a photoreceptor having an undercoat layer generated from a mixture of a polyhydroxyalkylacrylate and an aminoalkyltrialkoxysilane.

SUMMARY OF THE INVENTION

The present invention is accomplished in embodiments by providing a photoreceptor including:

(a) a substrate;

(b) a charge blocking layer comprising a polymer polymerized from at least one monomer including vinylbenzyl alcohol monomer; and (c) at least one imaging layer.

BRIEF DESCRIPTION OF THE DRAWINGS

The FIGURE is a cross-sectional view of a preferred multi-layer photoreceptor of the present invention.

DETAILED DESCRIPTION

A representative structure of an electrophotographic imaging member is shown in the FIGURE. This imaging member is provided with an anti-curl layer 1, a supporting substrate 2, an electrically conductive ground plane 3, a charge blocking layer 4, an adhesive layer 5, a charge generating layer 6, a charge transport layer 7, an overcoating layer 8, and a ground strip 9. The imaging member can be a photoreceptor.

The Anti-Curl Layer

For some applications, an optional anti-curl layer 1 can be provided, which comprises film-forming organic or inorganic polymers that are electrically insulating or slightly semi-conductive. The anti-curl layer provides flatness and/or abrasion resistance.

Anti-curl layer 1 can be formed at the back side of the substrate 2, opposite the imaging layers. The anti-curl layer may include, in addition to the film-forming resin, an adhesion promoter polyester additive. Examples of film-forming resins useful as the anti-curl layer include, but are not limited to, polyacrylate, polystyrene, poly(4,4'-isopropylidene diphenylcarbonate), poly(4,4'-cyclohexylidene diphenylcarbonate), mixtures thereof and the like.

Additives may be present in the anti-curl layer in the range of about 0.5 to about 40 weight percent of the anti-curl layer. Preferred additives include organic and inorganic particles which can further improve the wear resistance and/or provide charge relaxation property. Preferred organic particles include Teflon powder, carbon black, and graphite particles. Preferred inorganic particles include insulating and semiconducting metal oxide particles such as silica, zinc oxide, tin oxide and the like. Another semiconducting additive is the oxidized oligomer salts as described in U.S. Pat. No. 5,853,906. The preferred oligomer salts are oxidized N, N, N', N'-tetra-p-tolyl-4,4'-biphenyldiamine salt.

Typical adhesion promoters useful as additives include, but are not limited to, duPont 49,000 (duPont), Vitel PE-100, Vitel PE-200, Vitel PE-307 (Goodyear), mixtures thereof and the like. Usually from about 1 to about 15 weight percent adhesion promoter is selected for film-forming resin addition, based on the weight of the film-forming resin.

The thickness of the anti-curl layer is typically from about 3 micrometers to about 35 micrometers and, preferably, about 14 micrometers. However, thicknesses outside these ranges can be used.

The anti-curl coating can be applied as a solution prepared by dissolving the film-forming resin and the adhesion promoter in a solvent such as methylene chloride. The solution may be applied to the rear surface of the supporting substrate (the side opposite the imaging layers) of the photoreceptor device, for example, by web coating or by other methods known in the art. Coating of the imaging layers on top of the substrate and the anti-curl layer can be accomplished simultaneously by web coating onto a mulilayer photoreceptor comprising a charge transport layer, charge generation layer, adhesive layer, blocking layer, ground plane and substrate. The wet film coating is then dried to produce the anti-curl layer 1.

The Supporting Substrate

As indicated above, the photoreceptors are prepared by first providing a substrate 2, i.e., a support. The substrate can be opaque or substantially transparent and can comprise any of numerous suitable materials having given required mechanical properties.

The substrate can comprise a layer of electrically non-conductive material or a layer of electrically conductive material, such as an inorganic or organic composition. If a non-conductive material is employed, it is necessary to provide an electrically conductive ground plane over such non-conductive material. If a conductive material is used as the substrate, a separate ground plane layer may not be necessary.

The substrate can be flexible or rigid and can have any of a number of different configurations, such as, for example, a sheet, a scroll, an endless flexible belt, a web, a cylinder, and the like. The photoreceptor may be coated on a rigid, opaque, conducting substrate, such as an aluminum drum.

Various resins can be used as electrically non-conducting materials, including, but not limited to, polyesters, polycarbonates, polyamides, polyurethanes, and the like. Such a substrate preferably comprises a commercially available biaxially oriented polyester known as MYLAR™, available from E. I. duPont de Nemours & Co., MELINEX™, available from ICI Americas Inc., or HOSTAPHAN™, available from American Hoechst Corporation. Other materials of which the substrate may be comprised include polymeric materials, such as polyvinyl fluride, available as TEDLAR™ from E. I. duPont de Nemours & co., polyethylene and polypropylene, available as MARLEX™ from Phillips Petroleum Company, polyphenylene sulfide, RYTON™ available from Phillips Petroleum Company, and polyimides, available as KAPTON™ from E. I. duPont de Nemours & Co. The photoreceptor can also be coated on an insulating plastic drum, provided a conducting ground plane has previously been coated on its surface, as described above. Such substrates can either be seamed or seamless.

When a conductive substrate is employed, any suitable conductive material can be used. For example, the conductive material can include, but is not limited to, metal flakes, powders or fibers, such as aluminum, titanium, nickel, chromium, brass, gold, stainless steel, carbon black, graphite, or the like, in a binder resin including metal oxides, sulfides, silicides, quaternary ammonium salt compositions, conductive polymers such as polyacetylene or its pyrolysis and molecular doped products, charge transfer complexes, and polyphenyl silane and molecular doped products from polyphenyl silane. A conducting plastic drum can be used, as well as the preferred conducting metal drum made from a material such as aluminum.

The preferred thickness of the substrate depends on numerous factors, including the required mechanical performance and economic considerations. The thickness of the substrate is typically within a range of from about 65 micrometers to about 150 micrometers, and preferably is from about 75 micrometers to about 125 micrometers for optimum flexibility and minimum induced surface bending stress when cycled around small diameter rollers, e.g., 19 mm diameter rollers. The substrate for a flexible belt can be of substantial thickness, for example, over 200 micrometers, or of minimum thickness, for example, less than 50 micrometers, provided there are no adverse effects on the final photoconductive device. Where a drum is used, the thickness should be sufficient to provide the necessary rigidity. This is usually about 1–6 mm.

The surface of the substrate to which a layer is to be applied is preferably cleaned to promote greater adhesion of such a layer. Cleaning can be effected, for example, by exposing the surface of the substrate layer to plasma discharge, ion bombardment, and the like. Other methods, such as solvent cleaning, can be used.

Regardless of any technique employed to form a metal layer, a thin layer of metal oxide generally forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer.

The Electrically Conductive Ground Plane

As stated above, photoreceptors prepared in accordance with the present invention comprise a substrate that is either electrically conductive or electrically non-conductive. When a non-conductive substrate is employed, an electrically conductive ground plane 3 must be employed, and the ground plane acts as the conductive layer. When a conductive substrate is employed, the substrate can act as the conductive layer, although a conductive ground plane may also be provided.

If an electrically conductive ground plane is used, it is positioned over the substrate. Suitable materials for the electrically conductive ground plane include, but are not limited to, aluminum, zirconium, niobium, tantalum, vanadium, hafnium, titanium, nickel, stainless steel, chromium, tungsten, molybdenum, copper, and the like, and mixtures and alloys thereof. In embodiments, aluminum, titanium, and zirconium are preferred.

The ground plane can be applied by known coating techniques, such as solution coating, vapor deposition, and sputtering. A preferred method of applying an electrically conductive ground plane is by vacuum deposition. Other suitable methods can also be used.

Preferred thicknesses of the ground plane are within a substantially wide range, depending on the optical transparency and flexibility desired for the electrophotoconductive member. Accordingly, for a flexible photoresponsive imaging device, the thickness of the conductive layer is preferably between about 20 angstroms and about 750 angstroms; more preferably, from about 50 angstroms to about 200 angstroms for an optimum combination of electrical conductivity, flexibility, and light transmission. However, the ground plane can, if desired, be opaque.

The Charge Blocking Layer

After deposition of any electrically conductive ground plane layer, a charge blocking layer 4 can be applied thereto. Electron blocking layers for positively charged photoreceptors permit holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer can be utilized.

If a blocking layer is employed, it is preferably positioned over the electrically conductive layer. The term "over," as used herein in connection with many different types of layers, should be understood as not being limited to instances wherein the layers are contiguous. Rather, the term refers to relative placement of the layers and encompasses the inclusion of unspecified intermediate layers.

The blocking layer includes a homopolymer of vinylbenzyl alcohol, a copolymer of vinylbenzyl alcohol and another monomer, or a terpolymer of vinylbenzyl alcohol and two other monomers, and the like. A preferred copolymer is poly(vinylbenzyl alcohol-vinylbenzylacetate). Mixtures of the polymers described herein may be used such as both poly(vinylbenzyl alcohol) and poly(vinylbenzyl alcohol-vinylbenzylacetate). The amount of vinylbenzyl alcohol in the copolymer and terpolymer ranges between about 25 and less than 100 mole percent, and more preferably between about 75 and about 95 mole percent, the balance being the other monomer or monomers such as vinylbenzylacetate. The concentration of hydroxyl groups is believed to provide the necessary conductivity and preferably should be in the range between about 5 and about 7.5 millimoles of hydroxyl group per gram of resin for optimum performance. This value is dependent on the formulation and the amount of gamma-aminopropyltriethoxysilane which is preferably added to the formulation as well. Suitable monomers for the copolymer and the terpolymer with vinylbenzyl alcohol include styrene, substituted styrenes, acrylates, methacrylates, vinyl acetate, vinyl chloride, and the like.

A silane such as an alkyltrialkoxy silane may be included in the blocking layer, wherein the alkyl and the alkoxy independently contain from 1 to 25 carbon atoms, preferably from 1 to 7 carbon atoms. Examples of silanes selected are methyltrichlorosilane, dimethyldichlorosilane, methyltrimethoxysilane, methyltriethoxysilane, ethyltrichlorosilane, ethyltrimethoxysilane, dimethyldimethoxysilane, methyl triethoxysilane, ethyltriethoxysilane, propyltrimethoxysilane, 3-aminopropyltrimethoxysilane, and 3-aminopropyltriethoxysilane; alkylhalosilanes, alkylalkoxysilanes, aminoalkylsilanes, and the like, and preferably 3-aminopropyltrimethoxysilane or 3-aminopropyltriethoxysilane. Preferably, alkyltrialkoxysilane is gamma-aminopropyltrimethoxysilane or gamma-aminopropyltriethoxysilane.

Poly(vinylbenzyl alcohol) is described in Jones, U.S. Pat. No. 3,879,328. The 3,879,328 patent teaches the preparation of vinylbenzyl alcohol from the hydrolysis of vinylbenzyl chloride followed by polymerization to poly(vinylbenzyl alcohol). However, the yields were low (about 5%) because the vinyl benzyl alcohol is formed in low yields from vinyl benzyl chloride (about 25 to 50%) and there is considerable difficulty in separating vinylbenzyl chloride starting material from the products vinyl benzyl alcohol and vinylbenzyl ether. Moreover, the divinylbenzyl ether that forms must be removed from the vinylbenzyl alcohol or crosslinking of the polyvinylbenzyl alcohol takes place with appreciable gel formation.

The present inventors have discovered that poly (vinylbenzyl alcohol) and poly(vinylbenzyl alcohol-vinylbenzyl acetate) can be made from poly(vinylbenzyl acetate) which itself was made from the reaction of commercially available poly(vinylbenzyl chloride) with sodium acetate. Poly(vinylbenzyl acetate) can also be made from vinylbenzyl acetate by free radical polymerization. Poly (vinylbenzyl acetate) is then hydrolyzed or reduced to form poly(vinylbenzyl alcohol). Partial hydrolysis or reduction of poly(vinylbenzyl acetate) produces copolymers of poly (vinylbenzyl alcohol-vinylbenzyl acetate).

Poly(vinylbenzyl alcohol), with a glass transition temperature of 136° C., and the copolymers of poly(vinylbenzyl alcohol-vinylbenzyl acetate) are useful as thick undercoat layers in photoreceptors either by themselves or with gamma-aminopropyltrialkoxysilane, where alkyl is typically methyl or ethyl.

Poly(vinylbenzyl chloride) was obtained from Aldrich or Scientific Polymer Products, Ontario, N.Y., and has a weight average molecular weight (Mw) of approximately 50,000. Because the polymer is typically prepared by the free radical polymerization of vinylbenzyl chloride, the polydispersity (the ratio of Mw to Mn, the number average molecular weight) is typically between 3 and 6. The poly(vinylbenzyl chloride) is reacted with sodium acetate in polar aprotic solvents such as N,N-dimethylacetamide, N,N-dimethylformamiide, N-methylpyrolidinone, dimethylsulfoxide, and the like, at 100° C. and is quantitatively converted to poly(vinylbenzyl acetate) within 16 hours. Poly(vinylbenzyl acetate), with a glass transition temperature of 38° C., is then selectively reduced to poly (vinylbenzyl alcohol) with a 1 molar solution of borane-tetrahydrofuran complex, available from Aldrich. Because 1 mole of borane reduces between 1 and 1.5 moles of benzyl acetate groups on the copolymer (depending on the purity of the poly(vinylbenzyl acetate) and the reaction conditions used), it is possible to precisely control and tailor the number of alcohol groups in the poly(vinylbenzyl alcohol) and the poly(vinylbenzyl alcohol-vinylbenzyl acetate) copolymers formed. Polymers produced with more 77 mole % benzyl alcohol groups are soluble in methanol, ethanol, propanol and Dowanol. Polymers with less than 77 mole % benzyl alcohol groups are soluble in tetrahydrofuran and alcohol-tetrahydrofuran mixtures. All are insoluble in water. Poly (vinylbenzyl alcohol) is insoluble in methylene chloride and tetrahydrofuran. It can be solubilized in these solvents by adding some alcohol. The molecular weights of the products produced are between 30,000 and 50,000 (weight average molecular weight).

The blocking layer can include filler particles of an electrically nonconductive material, a n-type semiconductive material, or an electrically conductive material, such filler particles including for example titanium dioxide, zinc oxide, silicon nitride, tin oxide, carbon black, and the like to provide further desirable electrical and optical properties. N-type semiconductive filler particles are preferred such as titanium dioxide and zinc oxide. Spherical particles of titanium dioxide form stable dispersions with the hydroxy-containing polymers as binders in alcohol solvents. The filler particles may be present in the dried blocking layer in an amount ranging for example from about 25% to about 95% by weight of the blocking layer, with 50 wt. % filler particles being preferred.

The blocking layer 4 can include other polymers, such as polyvinyl butyral, epoxy resins, polyesters, polysiloxanes, polyamides, polyurethanes, and the like; nitrogen-containing siloxanes or nitrogen-containing titanium compounds, such as trimethoxysilyl propyl ethylene diamine, N-beta(aminoethyl) gamma-aminopropyl trimethoxy silane, isopropyl 4-aminobenzene sulfonyl titanate, di(dodecylbenezene sulfonyl) titanate, isopropyl di(4-aminobenzoyl)isostearoyl titanate, isopropyl tri(N-ethyl amino) titanate, isopropyl trianthranil titanate, isopropyl tri(N,N-dimethyl-ethyl amino) titanate, titanium-4-amino benzene sulfonate oxyacetate, titanium 4-aminobenzoate isostearate oxyacetate, gamma-aminobutyl methyl dimethoxy silane, gamma-aminopropyl methyl dimethoxy silane, and gamma-aminopropyl trimethoxy silane, as disclosed in U.S. Pat. Nos. 4,338,387, 4,286,033, and 4,291,110.

The blocking layer 4 should be continuous and can have a thickness ranging for example from about 0.05 to about 5 micrometers, preferably from about 0.1 to about 3 micrometers.

The blocking layer 4 can be applied by any suitable technique, such as spraying, dip coating, draw bar coating, gravure coating, silk screening, air knife coating, reverse roll coating, vacuum deposition, chemical treatment, and the like. For convenience in obtaining thin layers, the blocking layer is preferably applied in the form of a dilute solution, with the solvent being removed after deposition of the coating by conventional techniques, such as by vacuum, heating, and the like. Generally, a weight ratio of blocking layer material and solvent of between about 0.5:100 to about 5.0:100 is satisfactory for spray coating.

The Adhesive Layer

An intermediate layer 5 between the blocking layer and the charge generating layer may, if desired, be provided to promote adhesion. However, in the present invention, a dip coated aluminum drum may be utilized without an adhesive layer.

Additionally, adhesive layers can be provided, if necessary, between any of the layers in the photoreceptors to ensure adhesion of any adjacent layers. Alternatively, or in addition, adhesive material can be incorporated into one or both of the respective layers to be adhered. Such optional adhesive layers preferably have thicknesses of about 0.001 micrometer to about 0.2 micrometer. Such an adhesive layer can be applied, for example, by dissolving adhesive material in an appropriate solvent, applying by hand, spraying, dip coating, draw bar coating, gravure coating, silk screening, air knife coating, vacuum deposition, chemical treatment, roll coating, wire wound rod coating, and the like, and drying to remove the solvent. Suitable adhesives include, for example, film-forming polymers, such as polyester, duPont 49,000 (available from E. I. duPont de Nemours & Co.), Vitel PE-100 (available from Goodyear Tire and Rubber Co.), polyvinyl butyral, polyvinyl pyrrolidone, polyurethane, polymethyl methacrylate, and the like. The adhesive layer may be composed of a polyester with a $M_w$ of from about 50,000 to about 100,000, and preferably about 70,000, and a $M_n$ of preferably about 35,000.

The Imaging Layer(s)

In fabricating a photosensitive imaging member, a charge generating material (CGM) and a charge transport material (CTM) may be deposited onto the substrate surface either in a laminate type configuration where the CGM and CTM are in different layers or in a single layer configuration where the CGM and CTM are in the same layer along with a binder resin. The photoreceptors embodying the present invention can be prepared by applying over the electrically conductive layer the charge generation layer 6 and, optionally, a charge transport layer 7. In embodiments, the charge generation layer and, when present, the charge transport layer, may be applied in either order.

Illustrative organic photoconductive charge generating materials include azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments such as benzimidazole perylene; indigo pigments such as indigo, thioindigo, and the like; bisbenzoimidazole pigments such as Indofast Orange, and the like; phthalocyanine pigments such as copper phthalocyanine, aluminochloro-phthalocyanine, hydroxygallium phthalocyanine, and the like; quinacridone pigments; or azulene compounds. Suitable inorganic photoconductive charge generating materials include for example cadium sulfide, cadmium sulfoselenide, cadmium selenide, crystalline and amorphous selenium, lead oxide and other chalcogenides. Alloys of selenium are encompassed by embodiments of the instant invention and include for instance selenium-arsenic, selenium-tellurium-arsenic, and selenium-tellurium.

Any suitable inactive resin binder material may be employed in the charge generating layer. Typical organic resinous binders include polycarbonates, acrylate polymers, methacrylate polymers, vinyl polymers, cellulose polymers, polyesters, polysiloxanes, polyamides, polyurethanes, epoxies, polyvinylacetals, polyvinylbutyrals, polyvinyl chloride-vinyl acetate-maleic acid terpolymers, and the like.

To create a dispersion useful as a coating composition, a solvent is used with the charge generating material. The solvent can be for example cyclohexanone, methyl ethyl ketone, tetrahydrofuran, alkyl acetate, and mixtures thereof. The alkyl acetate (such as butyl acetate and amyl acetate) can have from 3 to 5 carbon atoms in the alkyl group. The amount of solvent in the composition ranges for example from about 85% to about 98% by weight, based on the weight of the composition.

The amount of the charge generating material in the composition ranges for example from about 0.5% to about 15% by weight, based on the weight of the composition including a solvent. The amount of photoconductive particles (i.e, the charge generating material) dispersed in a dried photoconductive coating varies to some extent with the specific photoconductive pigment particles selected. For example, when phthalocyanine organic pigments such as titanyl phthalocyanine and metal-free phthalocyanine are utilized, satisfactory results are achieved when the dried photoconductive coating comprises between about 50 percent by weight and about 90 percent by weight of all phthalocyanine pigments based on the total weight of the dried photoconductive coating. Since the photoconductive characteristics are affected by the relative amount of pigment per square centimeter coated, a lower pigment loading may be utilized if the dried photoconductive coating layer is thicker. Conversely, higher pigment loadings are desirable where the dried photoconductive layer is to be thinner.

Generally, satisfactory results are achieved with an average photoconductive particle size of less than about 0.6 micrometer when the photoconductive coating is applied by dip coating. Preferably, the average photoconductive particle size is less than about 0.4 micrometer. Preferably, the photoconductive particle size is also less than the thickness of the dried photoconductive coating in which it is dispersed.

The weight ratio of the charge generating material ("CGM") to the binder ranges from 40 (CGM):60 (binder) to 70 (CGM):30 (binder).

For multilayered photoreceptors comprising a charge generating layer (also referred herein as a photoconductive layer) and a charge transport layer, satisfactory results may be achieved with a dried photoconductive layer coating thickness of between about 0.1 micrometer and about 10 micrometers. Preferably, the photoconductive layer thickness is between about 0.2 micrometer and about 4 micrometers. However, these thicknesses also depend upon the pigment loading. Thus, higher pigment loadings permit the use of thinner photoconductive coatings. Thicknesses outside these ranges can be selected providing the objectives of the present invention are achieved.

Any suitable technique may be utilized to disperse the photoconductive particles in the binder and solvent of the coating composition. Typical dispersion techniques include, for example, ball milling, roll milling, milling in vertical attritors, sand milling, and the like. Typical milling times using a ball roll mill is between about 4 and about 6 days.

Charge transport materials include an organic polymer or non-polymeric material capable of supporting the injection of photoexcited holes or transporting electrons from the photoconductive material and allowing the transport of these holes or electrons through the organic layer to selectively dissipate a surface charge. Illustrative charge transport materials include for example a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and hydrazone compounds. Typical hole transport materials include electron donor materials, such as carbazole; N-ethyl carbazole; N-isopropyl carbazole; N-phenyl carbazole; tetraphenylpyrene; 1-methyl pyrene; perylene; chrysene; anthracene; tetraphene; 2-phenyl naphthalene; azopyrene; 1-ethyl pyrene; acetyl pyrene; 2,3-benzochrysene; 2,4-benzopyrene; 1,4-bromopyrene; poly (N-vinylcarbazole); poly(vinylpyrene); poly(vinyltetraphene); poly(vinyltetracene) and poly (vinylperylene). Suitable electron transport materials include electron acceptors such as 2,4,7-trinitro-9-fluorenone; 2,4,5,7-tetranitro-fluorenone; dinitroanthracene; dinitroacridene; tetracyanopyrene; dinitroanthraquinone; and butylcarbonylfluorenemalononitrile, reference U.S. Pat. No. 4,921,769. Other hole transporting materials include arylamines described in U.S. Pat. No. 4,265,990, such as N,N'-diphenyl-N,N'-bis(alkylphenyl)-(1,1'-biphenyl)-4,4'-diamine wherein alkyl is selected from the group consisting of methyl, ethyl, propyl, butyl, hexyl, and the like. Other known charge transport layer molecules can be selected, reference for example U.S. Pat. Nos. 4,921,773 and 4,464,450, the disclosures of which are totally incorporated herein by reference.

Any suitable inactive resin binder may be employed in the charge transport layer. Typical inactive resin binders soluble in methylene chloride include polycarbonate resin, polyvinylcarbazole, polyester, polyarylate, polystyrene, polyacrylate, polyether, polysulfone, and the like. Molecular weights can vary from about 20,000 to about 1,500,000.

Any suitable technique may be utilized to apply the charge transport layer and the charge generating layer to the substrate. Typical coating techniques include dip coating, roll coating, spray coating, rotary atomizers, and the like. The coating techniques may use a wide concentration of solids. Preferably, the solids content is between about 2 percent by weight and 8 percent by weight based on the total weight of the dispersion. The expression "solids" refers to the photoconductive pigment particles and binder components of the charge generating coating dispersion and to the charge transport particles and binder components of the charge transport coating dispersion. These solids concentrations are useful in dip coating, roll, spray coating, and the like. Generally, a more concentrated coating dispersion is prefelTed for roll coating. Drying of the deposited coating may be effected by any suitable conventional technique such as oven drying, infra-red radiation drying, air drying and the like. Generally, the thickness of the charge generating layer ranges from about 0.1 micrometer to about 3 micrometers and the thickness of the transport layer is between about 5 micrometers to about 100 micrometers, but thicknesses outside these ranges can also be used. In general, the ratio of the thickness of the charge transport layer to the charge generating layer is preferably maintained from about 2:1 to 200:1 and in some instances as great as 400:1.

The Overcoating Layer

Embodiments in accordance with the present invention can, optionally, further include an overcoating layer or layers 8, which, if employed, are positioned over the charge generation layer or over the charge transport layer. This layer comprises organic polymers or inorganic polymers that are electrically insulating or slightly semi-conductive.

Such a protective overcoating layer includes a film forming resin binder optionally doped with a charge transport material.

Any suitable film-forming inactive resin binder can be employed in the overcoating layer of the present invention. For example, the film forming binder can be any of a number of resins, such as polycarbonates, polyarylates, polystyrene, polysulfone, polyphenylene sulfide, polyetherimide, polyphenylene vinylene, and polyacrylate. The resin binder used in the overcoating layer can be the same or different from the resin binder used in the anti-curl layer or in any charge transport layer that may be present. The binder resin should preferably have a Young's modulus greater than about $2\times10^5$ psi, a break elongation no less than 10%, and a glass transition temperature greater than about 150 degrees C. The binder may further be a blend of binders. The preferred polymeric film forming binders include MAKROLON™, a polycarbonate resin having a weight average molecular weight of about 50,000 to about 100,000 available from Farbenfabriken Bayer A. G., 4,4'-cyclohexylidene diphenyl polycarbonate, available from Mitsubishi Chemicals, high molecular weight LEXAN™ 135, available from the General Electric Company, ARDEL™ polyarylate D-100, available from Union Carbide, and polymer blends of MAKROLON™ and the copolyester VITEL™ PE-100 or VITEL™ PE-200, available from Goodyear Tire and Rubber Co.

In embodiments, a range of about 1% by weight to about 10% by weight of the overcoating layer of VITEL™ copolymer is preferred in blending compositions, and, more preferably, about 3% by weight to about 7% by weight. Other polymers that can be used as resins in the overcoat layer include DUREL™ polyarylate from Celanese, polycarbonate copolymers LEXAN™ 3250, LEXAN™ PPC 4501, and LEXAN™ PPC 4701 from the General Electric Company, and CALIBRE™ from Dow.

Additives may be present in the overcoating layer in the range of about 0.5 to about 40 weight percent of the overcoating layer. Preferred additives include organic and inorganic particles which can further improve the wear resistance and/or provide charge relaxation property. Preferred organic particles include Teflon powder, carbon black, and graphite particles. Preferred inorganic particles include insulating and semiconducting metal oxide particles such as silica, zinc oxide, tin oxide and the like. Another semiconducting additive is the oxidized oligomer salts as described in U.S. Pat. No. 5,853,906. The preferred oligomer salts are oxidized N, N, N', N'-tetra-p-tolyl-4,4'-biphenyldiamine salt.

The overcoating layer can be prepared by any suitable conventional technique and applied by any of a number of application methods. Typical application methods include, for example, hand coating, spray coating, web coating, dip coating and the like. Drying of the deposited coating can be effected by any suitable conventional techniques, such as oven drying, infrared radiation drying, air drying, and the like.

Overcoatings of from about 3 micrometers to about 7 micrometers are effective in preventing charge transport molecule leaching, crystallization, and charge transport layer cracking. Preferably, a layer having a thickness of from about 3 micrometers to about 5 micrometers is employed.

The Ground Strip

Ground strip 9 can comprise a film-forming binder and electrically conductive particles. Cellulose may be used to disperse the conductive particles. Any suitable electrically conductive particles can be used in the electrically conductive ground strip layer 9. The ground strip 9 can, for example, comprise materials that include those enumerated in U.S. Pat. No. 4,664,995. Typical electrically conductive particles include, but are not limited to, carbon black, graphite, copper, silver, gold, nickel, tantalum, chromium, zirconium, vanadium, niobium, indium tin oxide, and the like.

The electrically conductive particles can have any suitable shape. Typical shapes include irregular, granular, spherical, elliptical, cubic, flake, filament, and the like. Preferably, the electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles through the matrix of the dried ground strip layer. Concentration of the conductive particles to be used in the ground strip depends on factors such as the conductivity of the specific conductive materials utilized.

In embodiments, the ground strip layer may have a thickness of from about 7 micrometers to about 42 micrometers and, preferably, from about 14 micrometers to about 27 micrometers.

Photoreceptors were made with poly(vinylbenzyl alcohol) and poly(vinylbenzyl alcohol-vinylbenzyl acetate) as follows. The hydroxy-containing polymer (1 gram) in methanol, ethanol, propanol or butanol (8 grams) is combined with between 0.1 and 2 equivalents of gamma-aminopropyltriethoxy or trimethoxy silane (and typically 50 weight percent based on resin solids) and then optionally acetic acid (0.3 gram per gram of gamma-aminopropyltriethoxysilane) and optionally water is added. The solution is stirred for about 16 hours and the viscosity of the solution is adjusted to about twenty centipoise as determined by Brookfield viscometer by the addition of alcohol solvent. Sometimes water is added to the formulations to facilitate the hydrolysis of gamma-aminopropyltrialkoxysilane. The solution is either dip coated or applicator bar coated onto a suitable substrate, usually metallized (Zr/Ti) Mylar or aluminum cylinder substrates. Typically, a Bird applicator bar with a 1 mil gap is used to apply the coating solution which is then dried in an oven at 135° C. for between 1 and 10 minutes. The thickness of the resultant layer is measured using a permascope, the TCI Autotest model DS (Eddy/Mag) manufactured by Twin City International, Inc., North Tonawanda, N.Y. 14120. Typical coating thickness is about 2 micrometers. This layer is optionally overcoated with a 0.5 wt. % solids solution of 49,000 adhesive (DuPont de Ncmours) applied with a 1-mil gap Bird applicator bar. This interfacial adhesive layer is typically dried for 3 minutes at 135° C. This adhesive layer is then overcoated with a binder photogenerator layer (BGL) of trigonal selenium (dispersed in poly(N-vinyl carbazole) with cyclohexanone, chlorogallium phthalocyanine (dispersed in VCMH or polyvinylbutyral) with butylacetate, hydroxygallium phthalocyanine (dispersed in either PCZ polycarbonate with tetrahydrofuran or polystyrene-block-polyvinylpyridine with toluene, or benzimidazole perylene dispersed in PCZ polycarbonate with tetrahydrofuran. The photogenerator layer is typically dried for five minutes at 135° C. The next layer is the charge transport layer prepared by dissolving 1 part TPD (N,N'-diphenyl-N,N-bis(3-methyl phenyl)-1,1'-biphenyl-4,4'-diamine) and 1 part Makrolon polycarbonate in 11.3 parts methylene chloride. The solution is applied with an 8 mil gap Bird applicator bar which is then ramp dried from 40° C. to 100° C. over 30 minutes. The dried transport layer is about 25 micrometers. The resultant photoresponsive imaging member was then tested in a cyclic Xerographic test scanner. Each photoreceptor device was mounted on a cylindrical aluminum drum substrate which was rotated on a shaft of a scanner. Each photoreceptor was charged by a corotron mounted along the periphery of the drum. The surface potential was measured as a function of time by capacitively coupled voltage probes placed at different locations around the shaft. The probes were calibrated by applying known potentials to the drum substrate. The photoreceptors on the drums were exposed by a light source located at a position near the drum downstream from the corotron. As the drum was rotated, the initial (pre-exposure) charging potential was measured by voltage probe 1. Further rotation leads to the exposure station, where the photoreceptor was exposed to monochromatic radiation of a known intensity. The photoreceptor was erased by light source located at a position upstream of charging. The measurements made included charging of the photoreceptor in a constant current or voltage mode. The photoreceptor was corona charged to a negative polarity. As the drum was rotated, the initial charging potential was measured by voltage probe 1. Further rotation lead to the exposure station, where the photoreceptor was exposed to monochromatic radiation of known intensity. The surface potential after exposure was measured by voltage probes 2 and 3. The photoreceptor was finally exposed to an erase lamp of appropriate intensity and any residual potential was measured by voltage probe 4. The process was repeated with the magnitude of the exposure automatically changed during the next cycle. The photodischarge characteristics were obtained by plotting the potentials at voltage probes 2 and 3 as a function of light exposure. The charge acceptance and dark decay were also measured in the scanner. The initial slope of the discharge curve is termed S in units of (volts $cm^2$/ergs) and the residual potential after erase is termed Vr. The devices were cycled for 10,000 cycles in a continuous mode in A zone (80° F., 80% relative humidity), B zone ( 20° C., 40% RH), or C zone (10° C., 10–15% RH).

As used herein, the phrase "hydroxy containing polymer" and the like refers to the polymer polymerized from at least one monomer including vinylbenzyl alcohol monomer; generally, this phrase refers to poly(vinylbenzyl alcohol).

Three different photoreceptor designs were investigated. In the first, the hydroxy containing polymer at 20 centipoise in ethanol was coated on a flexible titanized Mylar substrate, followed by the optional 49,000 adhesive layer, followed by the binder photogenerator layer, followed by the charge transport layer. In the second device, a layer of hydrolyzed gamma-aminotriethoxysilane, as per U.S. Pat. No. 4,464,450, was coated on top of the hydroxy containing polymer layer, followed by the optional interfacial adhesive layer, followed by the binder-photogenerator layer, and then followed by the charge transport layer. The third photoreceptor design consisted of a mixture made by the combination of the hydroxy containing polymer with gamma-aminopropyltriethoxysilane and optional acetic acid (0.3 gram of acetic acid per gram of gamma-aminopropyltriethoxysilane), followed by the optional interfacial 49,000 adhesive layer, followed by the binder-photogenerator layer, and then followed by the charge transport layer. From these experiments the following was determined. The polyhydroxy containing polymers appear satisfactory for 10,000 scans in C zone (15° C., 10% relative humidity), but some cycle-up (residual voltage after light erase) sometimes remained after 30,000 scans. This effect was reversed at higher relative humidity and 25° C. The conclusion from this experiment is that water might be involved in the electron transport mechanism. In the absence of water at 0% relative humidity, oxidation of the alcohol groups may occur. When gamma-aminopropyltriethoxysilane is present, this cycle-up does not occur even at 0% relative humidity after 50,000 cycles. It is believed gamma-aminopropyltriethoxysilane either prevents oxidation of the hydroxy groups or chemically reduces the oxidized species back to hydroxyl groups. Whatever the mechanism, a silane such as gamma-aminopropyltriethoxysilane is desirable in the thick undercoat formulations. Moreover, gamma-aminopropyltriethoxysilane promotes interlayer adhesion.

Charge Deficient Spots (CDS) values in A zone (80° C., 80% relative humidity) were measured for aluminum cylinder photoreceptors with chlorogallium phthalocyanine photogenerators for the various benzyl alcohol containing polymers with and without gamma-aminopropyltriethoxysilane, and both with and without acetic acid. The conclusions are as follows. First, acetic acid makes no difference in the formulation with respect to the number of CDS values measured. All the polymers and copolymers had low CDS values (less than 100 with 1000 being acceptable) with the exception of poly(85 mole %-vinylbenzyl alcohol-15 mole % vinylbenzyl acetate) which had CDS values of about 2000. When this polymer was reprecipitated from ethanol into methylene chloride, the resultant product produced organic photoreceptors with low CDS values <100). The conclusion from this experiment is that there is a methylene chloride soluble contaminant causing the high CDS values. Thus, these hydroxy-containing polymers can be purified by washing with methylene chloride. The cycle-up at greater than 10,000 scans still occurred with the purified, low CDS, blocking layer polymers and copolymers in A zone. Thus, gamma-aminopropyltriethoxysilane (at between 25 and 50 wt. %) is required in certain embodiments to prevent device cycle-up in low relative humidity environment. Moreover, high purity hydroxy polymers are required for optimum performance and low CDS undercoat layers in organic photoreceptors.

In addition to poly(vinylbenzyl alcohol), poly (vinylbenzyl alcohol-vinylbenzyl acetate) copolymers were made with 93.5, 85, 76.5, 0.55, and 36.5 mole % benzyl alcohol groups. All produced organic photoreceptors with low CDS values (less than 200 counts). When gamma-aminopropyltriethoxy silane was added (at 50 wt. % based on hydroxy-containing polymer), the following CDS values were determined for the organic cylindrical drum photoreceptors made with the resulting undercoat layers: between 1880 (5 micrometers thick) and 2400 counts (2 micrometers thick) for poly(vinylbenzyl alcohol), between 500 (5 micrometers thick) and 1000 counts for (2 micrometers thick) poly(76.5 mole % vinylbenzyl alcohol-23.5 mole % vinylbenzyl acetate copolymer), between 30 (5 micrometers thick) and 80 counts (2 micrometers thick) for poly(55 mole % vinylbenzyl alcohol-0.45 mole % vinylbenzyl acetate), and between 95 (5 micrometers thick) and 5000 counts (2 micrometers thick) for poly(36.5 mole % vinyl benzyl alcohol-63.5 mole % vinylbenzyl acetate). Thick undercoat layers at about 5 micrometers may be superior to thin (2 micrometers) layers with respect to CDS values. A CDS value of less than 1000 is considered acceptable. The high CDS values of the 36.5 mole % copolymer is probably a consequence of the thin undercoat layer dissolving in the photogenerator dispersion solvent when the next layer is coated. The residual voltage values after light erase compared with the control drum of between 11 and 40 volts were as follows: 7 volts for poly(vinylbenzyl alcohol), between 6 and 9 volts for poly(76.5 mole % vinylbenzyl alcohol-vinylbenzyl acetate), between 36 and 38 volts for poly(55 mole % vinylbenzyl alcohol-vinylbenzyl acetate) and between 17 and 26 volts for poly(36.5 mole % vinylbenzyl alcohol-vinylbenzyl acetate). The last value is probably so unexpectedly low because the undercoat layer partially dissolves in the next coated layer, that is, the photogenerator dispersion layer.

When gamma-aminopropyltriethoxysilane was added at 25 wt. % based on poly(93.5 mole % vinylbenzyl alcohol-vinylbenzyl acetate), cyclic stability in C zone was nearly maintained (the cycle-up was less than 20 volts over 30,000 cycles). The Vr in C zone was less than 40 volts after 30,000 cycles. Moreover, the CDS values were less than 100 counts. Thus, the optimum amount of gamma-aminopropyltriethoxysilane added to the formulation is between about 25 and about 50 wt. % based on the amount of benzyl alcohol containing polymer to assure cyclic stability in C zone and low CDS values in A zone.

Residual voltages were also determined for organic photoreceptors made with the various undercoat layers on metallized Mylar substrates with hydroxygallium phthalocyanine photogenerator dispersion. These were as follows: 19 volts for poly(vinylbenzyl alcohol) (7.5 millimole hydroxy groups per gram), 23 volts for poly(93.5 mole % vinylbenzyl alcohol-vinylbenzyl acetate) (6.84 mmol OH/g), 35 volts for poly(85 mole % vinylbenzyl alcohol-vinylbenzyl acetate) (6.06 mmol OH/g), 96 volts for poly (76.5 mole % vinylbenzyl alcohol-vinylbenzyl acetate) (5.36 mmol OH/g), 135 volts for poly(55 mole % vinylbenzyl alcohol-vinylbenzyl acetate) (3.6 mmol OH/g), and 190 volts for poly(36.5 mole % vinylbenzyl alcohol-vinylbenzyl acetate) (2.31 mmol OH/g). The Vr of the control photoreceptor was 20 volts. Optimized hydroxy containing polymers look good electrically for 10,000 scans each in A, B, and C zones. Vr increased markedly with decreasing hydroxyl groups and the optimum benzyl alcohol content is between 76.5 and 100 mol %. The addition of gamma-aminopropyltriethoxysilane serves to further lower Vr and to improve interlayer adhesion. CDS values are higher for benzyl alcohol containing polymers when gamma-aminopropyltriethoxysilane is added and the optimum amount of silane is less than 50 weight % based on the amount of hydroxy containing polymer.

The photoinduced dicharge curves (PIDC) were all excellent. The electrical properties of optimized benzyl alcohol containing polymers look good both with and without gamma-aminopropytriethoxysilane on both photoreceptor drums and flexible photoreceptor substrates. Moreover, it is possible to tailor benzyl alcohol containing polymers with low Vr and CDS values for a variety of photogenerator layers and manufacturing conditions. Thus, benzyl alcohol containing polymers are excellent undercoat layers for photoreceptors.

The invention will now be described in detail with respect to specific preferred embodiments thereof, it being understood that these examples are intended to be illustrative only and the invention is not intended to be limited to the materials, conditions, or process parameters recited herein. All percentages and parts are by weight unless otherwise indicated.

In the Examples below, the phrase "F-X 3 component" refers to an undercoat layer made with gamma-aminopropyltriethoxysilane (6.2 parts), tributoxyzirconium acetylacetonate (45.8 parts) and polyvinylbutyral (BMS, 3.2 parts) in 1-butanol (59.8 parts) as the solvent. This so-called "three component" undercoat layer requires humidification during the drying step and the dried layer thickness is limited to about 1.5 microns for optimum performance.

EXAMPLE 1

Control Devices

Control photoreceptor devices were made with hydrolyzed gamma-aminopropyltriethoxysilane (γ-APS) as the undercoat in accordance with U.S. Pat. No. 4,464,450. A coating solution was made by adding gamma-aminopropyltriethoxysilane (γ-APS, 1 gram, obtained from Aldrich or Dow Corning) to deionized water (4 grams) and the solution was magnetically stirred for 4 hours. Glacial acetic acid (0.3 grams) was then added and stirring was continued for 10 minutes. Ethanol (74.7 grams) was then added followed by heptane (or octane, 20 grams). The coating solution was applied to a substrate comprising a vacuum deposited titanium layer on a polyethylene terepthalate film substrate using a 1 mil gap Bird applicator. The coating was oven dried for between 1 and 10 minutes at 135° C. To this layer was applied a 0.5 weight percent solution of 49,000 adhesive (DuPont deNemours) in methylene chloride using a 1-mil gap Bird applicator and the resultant film was dried for between 1 and 10 minutes with 3 to 5 minutes being preferred at 135° C. To this layer was applied a photogenerator layer consisting of 40 wt. % solids toluene dispersion of hydroxygallium phthalocyanine with a 11,000 molecular weight binder polymer consisting of polystyrene-block-polyvinylpyridine. The dispersion was made by roll-milling 1.33 grams of hydroxygallium phthalocyanine with 1.5 grams of the block copolymer at 7% solids in toluene for 24 hours with steel shot. The dispersion was then diluted to 4% solids and applied using a 0.5 mil gap Bird applicator. The binder-photogenerator layer was then oven dried at 135° C. for 5 minutes. A charge transport layer solution was made by dissolving TPD (N,N'-diphenyl-N,N'-bis(methylphenyl)-1,1-biphenyl-4,4'-diamine, 1.2 grams) in Makrolon polycarbonate (1.2 grams) in 13.45 grams of methylene chloride. This solution was then applied using an 8 mil gap Bird applicator and the layer was oven dried by ramping the temperature from 40° C. to 100° C. over 30 minutes. The resultant dried charge transport layer film was 25 micrometers. The photoresponsive device (photoreceptor) was analyzed using a cyclic scanner test fixture (described previously) and the results are summarized below. The variable for these devices was the time/temperature drying of the of the gamma aminopropyltriethoxysilane undercoat layer. The time/temperature are indicated in the sample description (if not indicated the drying time/temperature is 5 minutes at 135° C.). In the following tables $V_0$ is the initial charging potential in volts, $V_{dd/sec}$ is the dark decay in volts per second, S is the initial slope of the Photo-induced Discharge Curve (PIDC) in units of ergs/(volts cm$^2$), $V_r$ is the residual potential after erase in volts, $V_{depl}$ is the depletion voltage (from the charging characteristics) in volts, $V_{cycle\text{-}up}$ is the rise in residual potential in 10,000 cycles, $V_{I3.8}$ is the potential of the PIDC at an exposure of 3.8 ergs/cm$^2$, $E_{½}$ is the energy required to discharge 50% of the potential and $qV_{20\,\mu C}$ is the potential from the charging characteristics at a charging current of 20 μC(micro Coulombs). Another variable was coating thickness of the siloxane undercoat layer. To increase the thickness, the hydrolyzed gamma-aminopropyltriethoxysilane (γ-APS) layer was coated, dried, overcoated with γ-APS again, and then dried. This is designated a 2× film. An additional γ-APS coating layer and drying step were used to make a 3× film thickness.

| Sample/Description | Vo | Vdd/sec | S | Vr | Vdepl | Vcycle-up | VI3.8 | E1/2 | qV20μC |
|---|---|---|---|---|---|---|---|---|---|
| 1A:γAPS/49K/HOGaPc/CTL | 798 | 115 | 316 | 25 | 7 | 8 | | 1.35 | 850 |
| 1B:γAPS(10 min/135)/49K/HOGaPc/CTL | 797 | 148 | 257 | 65 | 5 | −10 | 115 | 1.65 | 650 |
| 1C:γAPS(1 min/135)/49K/HOGaPc/CTL | 799 | 161 | 376 | 23 | 23 | −13 | 72 | 1.19 | 900 |
| 1D:γAPS(3 min/135)/49K/HOGaPc/CTL | 798 | 136 | 295 | 21 | −19 | 6 | 65 | 1.44 | 800 |
| 1E:γAPS/49K/HOGaPc/CTL | 797 | 94 | 284 | 14 | 26 | 0.2 | 67 | 1.49 | 800 |
| 1F:γAPS/49K/HOGaPc/CTL | 796 | 80 | 273 | 32 | 38 | −4 | 88 | 1.56 | 850 |
| 1G:γAPS/49K/HOGaPc/CTL | 799 | 119 | 272 | 23 | 38 | −5 | 83 | 1.57 | 775 |
| 1H:γAPS(thick,0.75μ/49K/HOGaPc/CTL | 799 | 115 | 284 | 4 | 20 | −3 | 79 | 1.54 | 800 |
| 1I:γAPS(thin)/49K/HOGaPc/CTL | 799 | 126 | 322 | −2 | −25 | −0.7 | 40 | 1.32 | 800 |
| 1J:γAPS/49K/HOGaPc/CTL | 800 | 64 | 367 | −5 | −7.1 | −0.3 | 21 | 1.15 | 975 |
| 1K:γAPS/HOGaPc/CTL | 798 | 56 | 304 | 6 | 8 | −7 | 65 | 1.43 | 900 |
| 1L:γAPS(3 min/135)/49K/HOGaPc/CTL | 798 | 203 | 297 | 3 | −10 | −0.4 | 53 | 1.43 | 775 |
| 1M:γAPS(1 min/135)/49K/HOGaPc/CTL | 798 | 136 | 289 | 10 | 6 | −0.8 | 66 | 1.48 | 750 |
| 1N:γAPS(5 min/135)/49K/HOGaPc/CTL | 798 | 109 | 305 | 4 | 12 | −0.8 | 51 | 1.40 | 810 |
| 1O:γAPS(10 min/135)/49K/HOGaPc/CTL | 798 | 106 | 337 | 2 | 15 | −1.5 | 45 | 1.27 | 910 |
| 1P:γAPS(thick,2x)/49K/HOGaPc/CTL | 796 | 58 | 318 | 15 | 12 | −0.9 | 55 | 1.34 | 825 |
| 1Q:γAPS(thick,3x)/49K/HOGaPc/CTL | 797 | 51 | 335 | 8 | 124 | −1.7 | 53 | 1.28 | 975 |
| 1R:γAPS(thin,1x)/49K/HOGaPc/CTL | 797 | 64 | 360 | −4 | 126 | 0.8 | 18 | 1.15 | 975 |
| 1S:γAPS/49K/HOGaPc/CTL | 799 | 57 | 345 | 12 | 17 | −1 | 35 | 1.23 | 1000 |
| 1T:γAPS/49K/HOGaPc/CTL | 800 | 78 | 336 | 1 | 13 | 1.6 | 33 | 1.25 | 850 |

-continued

| Sample/Description | Vo | Vdd/sec | S | Vr | Vdepl | Vcycle-up | VI3.8 | E1/2 | qV20μC |
|---|---|---|---|---|---|---|---|---|---|
| 1U:γAPS/49K/HOGaPc/CTL | 796 | 105 | 423 | −2 | 6 | 0.4 | 13 | 0.98 | 1050 |
| 1V:γAPS/49K/HOGaPc/CTL | 804 | 101 | 297 | 19 | −31 | −4.4 | 94 | 1.51 | 800 |
| 1W:γAPS/49K/HOGaPc/CTL | 799 | 64 | 253 | 72 | 59 | −7.8 | 141 | 1.73 | 800 |
| 1X:γAPS/49K/HOGaPc/CTL | 797 | 38 | 282 | 84 | 78 | 54 | 160 | 1.64 | 1100 |
| 1Y:γAPS/49K/HOGaPc/CTL | 800 | 116 | 289 | 42 | 47 | −1.4 | | 825 | |
| 1Z:γPS/49K/HOGaPc/CTL | 799 | 51 | 253 | 59 | 79 | −13 | | 900 | |
| 1A:γPS/49K/HOGaPc/CTL | 798 | 86 | 284 | 14 | 22 | 2 | | 900 | |

The electrical properties of an average control sample of gamma-aminotriethoxysilane with hydroxygallium phthalocyanine photogenerator was thus determined to be the following: Vo=798, Vdd/sec=98, S=309, Vr=20 volts, Vdepl=26, Vcycle-up=0, $VI_{3.8}$=66, $E_{1/2}$=1.39, and qV20 μC=864.

EXAMPLE 2

Materials. Poly(vinylbenzyl chloride), catalog number M311, was obtained from Scientific Polymer Products, Ontario, N.Y., and had a weight average molecular weight Mw of about 50,000. Sodium acetate and anhydrous N,N-dimethylacetamide were obtained from Aldrich Chemical Co. Methanol and methylene chloride were obtained from Fisher Scientific.

Preparation of Poly(Vinylbenzyl Acetate). Poly (vinylbenzyl chloride) (200 grams) in N,N-dimethylacetamide (4-liters, 3,800 grams) were heated using a silicone oil bath at 200° F. for 24 hours in a 5-liter, 3-neck flask under argon equipped with a mechanical stirrer, reflux condenser, argon inlet, and stopper. The resultant solution was decanted off and separated from the salts that crystallized out on cooling and was added to water at a ratio of 25 mL of polymer solution for every 1 liter of water using a Waring blender that was speed controlled with a variable transformer (Variac). The precipitated polymer was collected by filtration, washed with water and then with methanol (2 gallons). The aggregated lump that formed was vacuum dried to yield poly(vinylbenzyl acetate) with a glass transition temperature (Tg) of 38° C. The lump was broken with a hammer and pulverized to a fine powder with a Waring blender. Although the conversion of chloromethyl groups to acetoyl methyl groups was 100% as determined using $^1$H NMR spectrometry, the recovered yield of poly (vinylbenzyl acetate) was only about 50% from poly (vinylbenzyl chloride).

EXAMPLE 3

Preparation of Poly(Vinylbenzyl Alcohol). Poly (vinylbenzyl acetate) (100 g, from Example 2) in anhydrous tetrahydrofuran (Aldrich, 1000 grams) was treated with 1-molar borane-tetrahydrofuran complex in tetrahydrofuran (Aldrich, 707.7 grams) and was heated at reflux for 2.5 hours in a 3-liter, 3-neck round-bottom flask equipped with a reflux condenser, mechanical stirrer, argon inlet and rubber septum. A gel formed which dispersed upon stirring. After cooling to 25° C., methanol was cautiously added and vigorous out gassing took place. A clear polymer solution formed that was added to water at a ratio of 25 mL of polymer solution for every 1 liter of water using a Waring blender controlled with a variable transformer (Variac). The precipitated polymer was collected by filtration, washed with water, and then was vacuum dried. The polymer was then washed with methylene chloride or was reprecipitated from ethanol or methanol into methylene chloride and then was vacuum dried. The conversion of benzyl acetate groups to benzyl alcohol groups was quantitative as determined by $^1$H NMR spectrometry. The recovered yield of poly (vinylbenzyl alcohol) with Tg of 136° C. was about 50% from poly(vinylbenzyl acetate).

EXAMPLE 4

Preparation of Poly(Vinylbenzyl Alcohol-Vinylbenzyl Acetate) Copolymers. Poly(vinylbenzyl acetate) (20 grams from Example 2) in anhydrous tetrahydrofuran (200 grams, Aldrich) were allowed to react with a 1 molar solution of borane-tetrahydrofuran complex (Aldrich) in a 1-liter, 3-neck, round-bottom flask situated in a silicone oil bath and equipped with an argon inlet, reflux condenser, mechanical stirrer, and rubber septum stopper. The amount of 1-molar borane-tetrahydrofuran complex solutions used determined the amount of benzyl alcohol groups formed. One mole of borane complex reduced 1 mole of benzyl acetate groups. Consequently, 53 mL (46.9 grams), 72 mL (63.7 grams), 108 mL (95.39 grams), 117 mL (103.4 grams) and 126 mL (111.5 grams) of 1 molar borane-THF complex when reacted with poly(vinylbenzyl acetate (20 grams in 200 grams THF) produced poly(vinylbenzyl alcohol-vinylbenzyl acetate) copolymers with 36.5, 55, 76.5, 85, and 93.5 mole % benzyl alcohol groups. For complete reduction to poly(vinylbenzyl alcohol), a minimum of 140 mL (124.5 grams) of 1 molar borane-THF complex is required. The reaction mixture was heated for at least 1 hour at reflux, and the polymer gelled and formed a dispersion upon stirring. When the reaction mixture returned to 25° C., methanol was cautiously added and vigorous out gassing took place. A clear polymer solution formed that was added to water at a ratio of 25 mL of polymer solution for every 1 liter of water using a Waring blender controlled with a variable transformer (Variac). The precipitated polymer was collected by filtration, washed with water, and then was vacuum dried. The conversion of benzyl acetate groups to benzyl alcohol groups was determined by $^1$H NMR spectrometry. The recovered yield of copolymer varied between 10 and 12 grams.

EXAMPLE 5

Preparation of Vinylbenzyl Alcohol and Polymerization to Poly(Vinylbenzyl Alcohol). A 1 liter, 3-neck, round-bottom flask equipped with a mechanical stirrer, reflux condenser, and stopper was situated in a silicone oil bath. Vinylbenzyl chloride (100 grams, Dow Chemical, Midland, Mich.) was then added to 50 wt. % aqueous sodium hydroxide (100 grams) in t-butanol (22 grams) and water (503 grams), see Giggin D. Jones, U.S. Pat. No. 3,879,328 (issued Apr. 22, 1975), "Curable Compositions of Polymers containing Labile Hydroxyl Groups." The mixture was heated at 90° C. for 30 hours. The organic layer was separated, dried over potassium carbonate, and distilled using a Kugelrohr apparatus (Aldrich) under reduced pressure. In a 500-mL, 3-neck round-bottom flask equipped with an Argon inlet, mechanical stirrer and stopper was placed 28 grams of vinylbenzyl alcohol (which was collected at 125° C. at 5 mm mercury from the Kugelrohr apparatus). To this was added 28 grams of ethanol and 0.2 grams of azobis(iso-butyronitrile). The reaction mixture was heated in an oil bath set at 90° C. for 4 hours. The polymer gelled. Ethanol (112 grams) was added and the mixture was heated. The mixture was filtered to yield 5 grams of soluble polymer in ethanol. The solution was concentrated using a rotary evaporator and added to methylene chloride (2 liters). The precipitated polymer was isolated by filtration and vacuum dried to yield 4.08 grams of poly(vinylbenzyl alcohol). This material produced good photoreceptors when used as an undercoat layer for hydroxygallium phthalocyanine photoreceptors.

EXAMPLE 6

Photoreceptor Preparation and Evaluation. Three different photoreceptor designs were investigated. In the first, the hydroxy containing polymer at 20 centipoise in ethanol was coated on a flexible titanized Mylar substrate, followed by the optional 49,000 adhesive layer, followed by the binder photogenerator layer, followed by the charge transport layer. In the second device, a layer of hydrolyzed gamma-aminotriethoxysilane (prepared as described above) was coated on top of the hydroxy containing polymer layer, followed by the optional interfacial adhesive layer, followed by the binder-photogenerator layer, and then followed by the charge transport layer. The third photoreceptor design consisted of the combination of the hydroxy containing polymer with gamma-aminopropyltriethoxysilane and optionally acetic acid (0.3 gram of acetic acid per gram of gamma-aminopropyltriethoxysilane), followed by the optional interfacial 49,000 adhesive layer, followed by the binder-photogenerator layer, and then followed by the charge transport layer. The procedure for preparation of the coating solution and the fabrication of the layers are described in Example 1. Each photoreceptor device was mounted on a cylindrical aluminum drum substrate which was rotated on a shaft of a scanner. Each photoreceptor was charged by a corotron mounted along the periphery of the drum. The surface potential was measured as a function of time by capacitively coupled voltage probes placed at different locations around the shaft. The probes were calibrated by applying known potentials to the drum substrate. The photoreceptors on the drums were exposed by a light source located at a position near the drum downstream from the corotron. As the drum was rotated, the initial (pre-exposure) charging potential was measured by voltage probe 1. Further rotation leads to the exposure station, where the photoreceptor was exposed to monochromatic radiation of a known intensity. The photoreceptor was erased by light source located at a position upstream of charging. The measurements made included charging of the photoreceptor in a constant current of voltage mode. The photoreceptor was corona charged to a negative polarity. As the drum was rotated, the initial charging potential was measured by voltage probe 1. Further rotation lead to the exposure station, where the photoreceptor was exposed to monochromatic radiation of known intensity. The surface potential after exposure was measured by voltage probes 2 and 3. The photoreceptor was finally exposed to an erase lamp of appropriate intensity and any residual potential was measured by voltage probe 4. The process was repeated with the magnitude of the exposure automatically changed during the next cycle. The photodischarge characteristics were obtained by plotting the potentials at voltage probes 2 and 3 as a function of light exposure. The charge acceptance and dark decay were also measured in the scanner. The initial slope of the discharge curve is termed S in units of (volts $cm^2$/ergs) and the residual potential after erase is termed $V_r$. The devices were cycled for 10,000 cycles each in a continuous mode in B zone (20° C., 40% RH), C zone (15° C., 10% RH) and A zone (26.6° C., 80% RH).

The polyhydroxy containing polymers appear satisfactory for 10,000 scans in C zone (15° C., 10% relative humidity), but some cycle-up (increase in residual voltage after light erase with cycles) sometimes remained after 30,000 scans. This effect was reversed at higher relative humidity and 25° C. The conclusion from this experiment is that water might be involved in the electron transport mechanism. In the absence of water at 0% relative humidity, oxidation of the alcohol groups may occur. When gamma-aminopropyltriethoxysilane is present, this cycle-up does not occur even at 0% relative humidity after 50,000 cycles. It is believed gamma-aminopropyltriethoxysilane either prevents oxidation of the hydroxy groups or chemically reduces the oxidized species back to hydroxyl groups. Whatever the mechanism, gamma-aminopropyltriethoxysilane is desirable in the thick undercoat formulations. Moreover, gamma-aminopropyltriethoxysilane promotes adhesion. In the tables below, the designation slash (/) refers to a separate coating layer, whereas a comma (,) refers to a mixture of the reagents in a single coating. γ-APS is gamma-aminopropyltriethoxysilane. γ-APMS is gamma-aminopropyltrimethoxysilane.

EXAMPLE 7

Photoreceptors Made with Undercoat Layers Coated from Solutions of Poly(Vinylbenzyl Alcohol) and Poly (vinylbenzyl Alcohol-Vinylbenzyl Acetate) Copolymers. A typical undercoat solution was made by adding 1 gram of benzyl alcohol containing polymer to 9 grams of ethanol. Tetrahydrofuran ("THF") was added to help dissolve copolymers with less than 85 mol % benzyl alcohol groups. For the 76.5 mole % vinylbenzyl alcohol ("VBA") copolymer, 1 gram of THF was added with 8 grams of ethanol. For the 55 mole % VBA copolymer, 2 grams of THF were added with 7 grams of ethanol, and for the 36.5 mole % VBA copolymer, 3 grams of THF were added with 6 grams of ethanol to form the solution. The solution was then coated on titanized Mylar with a 1 mil gap Bird applicator. After heating between 1 and 10 minutes at 135° C., the dried film thickness was approximately 1 micrometer. A 49,000 adhesive layer was then applied as a 0.5 wt. % solids solution in methylene chloride using a 1-mil Bird applicator. The resultant film was dried for 3 minutes at 135° C. To this layer was applied a photogenerator layer consisting of 40 wt. % solids toluene dispersion of hydroxygallium phthalocyanine with a 11,000 molecular weight binder polymer consisting of polystyrene-block-polyvinylpyridine. The dispersion was made by roll-milling 1.33 grams of hydroxygallium phthalocyanine with 1.5 grams of the block copolymer at 7% solids in toluene for 24 hours with steel shot. The dispersion was then diluted to 4% solids with toluene and applied using a 0.5 mil gap Bird applicator. The binder-photogenerator layer was then oven dried at 135° C. for 5 minutes. A charge transport layer solution was made by dissolving TPD (N,N'-diphenyl-N,N'-bis(methylphenyl)-1,1-biphenyl-4,4'-diamine, 1.2 parts) in Makrolon polycarbonate (1.2 parts) in 13.45 parts of methylene chloride. This solution was then applied using an 8 mil gap Bird applicator and the layer was oven dried by ramping the temperature from 40° C. to 100° C. over 30 minutes. The resultant dried charge transport layer film was 25 micrometers. The photoresponsive device (photoreceptor) was analyzed using a cyclic scanner test fixture described earlier A summary of the electrical results obtained is presented in the Table below.

Electrical Properties of Poly(vinyl benzyl alcohol) Containing Polymers

| Sample/Description | Vo | Vdd/sec | S | Vr | Vdepl | Vcycle-up | VI3.8 | E1/2 | qV20μC |
|---|---|---|---|---|---|---|---|---|---|
| 7A: 100 mol % P(VBA) | 814 | 143 | 274 | 27 | −12 | −0.3 | 80 | | 850 |
| 7B: 100 mol % P(VBA) | 800 | 118 | 288 | 4 | −61 | 3.9 | 39 | 1.44 | 710 |
| 7C: 100 mol % P(VBA) | 796 | 135 | 302 | 24 | −26 | 10 | 38 | 1.34 | 800 |
| 7D: 100 mol % P(VBA) | 798 | 122 | 280 | 25 | −39 | 12.4 | 38 | 1.45 | 750 |
| 7E: 94 mol % P(VBA)-(VBAc) | 798 | 113 | 258 | 17 | −15 | −3 | | | 950 |
| 7F: 94 mol % P(VBA)-(VBAc) | 797 | 159 | 281 | 24 | −33 | 10 | | | 700 |
| 7G: 85 mol % P(VBA)-(VBAc) | 799 | 116 | 268 | 33 | 2.5 | 0.8 | | 1.38 | 850 |
| 7H: 77 mol % P(VBA)-(VBAc) | 795 | 191 | 286 | 96 | 195 | 76 | | 1.50 | 1100 |
| 7I:)77 mol % P(VBA)-(VBAc) | 791 | 112 | 269 | 124 | 162 | 19 | | | 950 |
| 7J: 55 mol % P(VBA)-(VBAc) | 796 | 122 | 352 | 135 | 90 | 8 | | | 1175 |
| 7K: 55 mol % P(VBA)-(VBAc) | 799 | 149 | 324 | 145 | 84 | 177 | | 1.44 | 1200 |
| 7L: 37 mol % P(VBA)-(VBAc) | 802 | 162 | 324 | 190 | 119 | 8 | | | 1250 |
| 7M: 37 mol % P(VBA)-(VBAc) | 796 | 110 | 365 | 406 | 303 | −6.4 | | | 1500 |
| Hand-coated Control Average | 798 | 98 | 309 | 20 | 26 | −0.1 | 66 | 1.39 | 864 |

EXAMPLE 8

Photoreceptors made with Undercoat Layers Coated from Solutions of Poly(Vinylbenzyl Alcohol) and Poly (vinylbenzyl Alcohol-Vinylbenzyl Acetate) Copolymers and Gamma-Aminopropyltriethoxysilane. A typical undercoat solution was made by adding 1 gram of gamma-aminopropyltriethoxysilane to a solution of poly (vinylbenzyl alcohol) containing polymer (1 gram in 9 grams of ethanol). Tetrahydrofuran ("THF") was added to help dissolve copolymers with less than 85 mol % benzyl alcohol groups. For the 76.5 mole % vinylbenzyl alcohol ("VBA") copolymer, 1 gram of THF was added with 8 grams of ethanol. For the 55 mole % VBA copolymer, 2 grams of THF were added with 7 grams of ethanol, and for the 36.5 mole % VBA copolymer, 3 grams of THF were added with 6 grams of ethanol to form the solution. Glacial acetic acid (0.3 grams) was optionally added. The solution was allowed to stand overnight (16 hours) and was then coated on titanized Mylar with a 1 mil gap Bird applicator. After heating between 1 and 10 minutes at 135° C., the dried film thickness was approximately 2 micrometers. A 49,000 adhesive layer was then applied as a 0.5 wt. % solids solution in methylene chloride using a 1-mil Bird applicator. Next, a binder photogenerator layer was applied and then the charge transfer layer was applied, as described above. The electrical properties of the resultant films are summarized below.

A Summary of the Electrical Properties of Poly (Vinylbenzyl Alcohol) with Gamma-Aminopropyltriethoxysilane)

| Sample/Description | Vo | Vdd/sec | S | Vr | Vdepl | Vcycle-up | VI3.8 | E1/2 | qV20μC |
|---|---|---|---|---|---|---|---|---|---|
| 8A: Poly(VBA)/γAPS/HOAc | 599 | 184 | 261 | 23 | 12 | −19 | 43 | 1.21 | 750 |
| 8B: Poly(VBA)/γAPS/HOAc | 800 | 157 | 270 | 28 | −5 | −19 | 77 | 1.56 | 700 |
| 8C: Poly(VBA)/γAPS/HOAc | 600 | 121 | 271 | 17 | 30 | −10 | 38 | 1.17 | 725 |
| 8D: Poly(VBA)/γAPS/HOAc | 799 | 112 | 284 | 16 | −117 | −10 | 65 | 1.49 | 725 |
| 8E: Poly(VBA)/γAPS/HOAc | 602 | 78 | 295 | 5.4 | 11 | 0.1 | 30 | 1.10 | 825 |
| 8F: Poly(VBA)/γAPS/HOAc | 799 | 93 | 297 | 3 | −4 | 0.1 | 51 | 1.18 | 800 |
| 8G: Poly(VBA)/γAPS/HOAc | 798 | 101 | 268 | 19 | 11 | 6.2 | 65 | 1.56 | 800 |
| 8H: Poly(VBA)/γAPS/HOAc | 793 | 223 | 277 | 45 | 22 | 8.6 | 80 | 1.56 | 700 |
| 8I: Poly(PVBA)/γAPS/HOAc | 800 | 130 | 288 | 10 | 1 | −1.5 | | | 800 |
| 8J: Poly(VBA)/γAPS/HOAc | 798 | 124 | 311 | 10 | 32 | −27 | 52 | 1.36 | 925 |
| 8K: Poly(VBA)/γAPS/HOAc | 796 | 102 | 284 | 9 | 23 | −0.8 | 53 | 1.48 | 900 |
| 8L: Poly(VBA)/γAPS/HOAc | 796 | 80 | 273 | 32 | 38 | −4 | 88 | 1.56 | 850 |
| Handcoated Control γAPS Average | 798 | 98 | 309 | 20 | 26 | −0.1 | 66 | 1.39 | 864 |

A Summary of the Electrical Properties of Benzyl Alcohol Containing Polymers with Gamma-Aminopropyltriethoxysilane: Note that Vr Increases with Decreasing Polymer Hydroxyl Numbers with the Exception of Sample 8F which Probably Dissolves in Subsequent Coatings

| Sample/Description | Vo | Vdd/sec | S | Vr | Vdepl | Vcycle-up | qV20μC |
|---|---|---|---|---|---|---|---|
| 8M: Poly(VBA)/γAPS/HOAc | 800 | 130 | 288 | 10 | 1 | −1.5 | 800 |
| 8N: 93.5 mol %Poly(VBA)-(VBAc)/γAPS/HOAc | 797 | 121 | 301 | 25 | 0.5 | 10 | 900 |
| 8O: 85 mol %Poly(VBA)-(VBAc)/γAPS/HOAc | 846 | 116 | 322 | 35 | 2.5 | 0.8 | 850 |
| 8P: 77 mol %Poly(VBA)-(VBAc)/γAPS/HOAc | 799 | 92 | 297 | 36 | 46 | 0.9 | 900 |

-continued

| Sample/Description | Vo | Vdd/sec | S | Vr | Vdepl | Vcycle-up | qV20μC |
|---|---|---|---|---|---|---|---|
| 8Q: 55 mol %Poly(VBA)/γAPS/HOAc | 800 | 72 | 248 | 53 | 45 | 7.8 | 775 |
| 8R: 37 mol %Poly(VBA)-(VBAc)/γAPS/HOAc | 799 | 68 | 323 | 33 | 53 | 12.9 | 1025 |
| Handcoated Control γAPS Average | 798 | 98 | 309 | 20 | 26 | −0.1 | 864 |

EXAMPLE 9

Organic Photoconductor Drum with ClGaPc Photogenerator. Poly(vinylbenzyl alcohol) (12 g in 69 g ethanol) and 12 g γ-APS were stirred for 16 hours and the resultant Brookfield viscosity was 29 cps. More ethanol (7.4 g) was added and the resultant viscosity was 25 cps. The procedure was repeated except glacial acetic acid (3.6 g) was added. The two respective solutions were used to dip coat aluminum drums at a pull rates of 100 mm/min. The coatings were oven dried for 40 minutes at 130° C. The thickness of the dried layer was 2 micrometers. Next chlorogallium phthalocyanine ("ClGaPc") photogenerator layer was applied followed by drying 15 minutes at 125° C. Finally, a PCZ polycarbonate—TPD charge transport layer was coated on top at 25 micrometers from chlorobenzene (20%) and THF. Drying was carried out at 125° C. for 40 minutes. The resultant photoreceptors had the electrical properties summarized below. The CDS values were approximately 2000 counts in A zone (80° F., 85% relative humidity).

| Sample | Vo | Q/A (PIDC) | Vdd/sec | dV/dx | Verase | Δ Erase | VL 15 ergs | Vdep |
|---|---|---|---|---|---|---|---|---|
| F-X 3 component control | 515 | 62 | 15 | 168 | 38 | 5 | 54 | 50 |
| Poly(VBA), γAPS, No HOAc | 524 | 69 | 3 | 169 | 7 | 1 | 17 | 20 |
| Poly(VBA), γAPS, HOAc | 523 | 69 | 4 | 174 | 7 | 1 | 15 | 23 |

EXAMPLE 10

Organic Photoreceptor Drum with ClGaPc Photogenerator. Poly(vinylbenzyl alcohol) (5 g) in 28.5 g ethanol were stirred for 16 hours and the resultant Brookfield viscosity was 41 cps. The solution was used to dip coat aluminum drums at a pull rate of 100 mm/min. The coatings were oven dried for 40 minutes at 130° C. The thickness of the dried layer was 2 micrometers. Next ClGaPc photogenerator layer was applied followed by drying 15 minutes at 125° C. Finally, a PCZ polycarbonate-TPD (TPD was defined in Example 7) charge transport layer was coated on top at 25 micrometers from chlorobenzene (20%) and THF. Drying was carried out at 125° C. for 40 minutes. The resultant photoreceptors had the electrical properties summarized below. The CDS values were approximately 200 counts in A zone (80° F., 85% relative humidity).

| Sample | Vo | Q/A (PIDC) | Vdd/sec | dV/dx | Verase | Δ Erase | VL 15 ergs | Vdep |
|---|---|---|---|---|---|---|---|---|
| F-X 3 component control | 522 | 74 | 7 | 133 | 11 | 2 | 26 | 21 |
| Poly(VBA) | 515 | 76 | 8 | 144 | 5 | 1 | 13 | 17 |

EXAMPLE 11

Organic Photoreceptor Drum with ClGaPc Photogenerator. Poly(76.5 mol % vinylbenzyl alcohol-vinylbenzyl acetate) (5 g) in 24.65 g ethanol and 4.10 grams of tetrahydrofuran were combined with 5 grams of gamma-aminotriethoxysilane and 1.5 grams of galcial acetic acid for 16 hours and the resultant Brookfield viscosity was 32.5 cps. Similarly poly(55 mol % vinylbenzyl alcohol-vinylbenzyl acetate) (5 g) in 20.55 g ethanol and 8.2 grams of tetrahydrofuran were combined with 5 grams of gamma-aminotriethoxysilane and 1.5 grams of galcial acetic acid for 16 hours and the resultant Brookfield viscosity was 11.5 centipoise. Also, poly(36.5 mol % vinylbenzyl alcohol-vinylbenzyl acetate) (5 g) in 16.45 g ethanol and 12.3 grams of tetrahydrofuran were combined with 5 grams of gamma-aminotriethoxysilane and 1.5 grams of glacial acetic acid for 16 hours and the resultant Brookfield viscosity was 5 cps. The solutions were used to dip coat aluminum drums at a pull rate of 100 mm/min. The coatings were oven dried for 40 minutes at 130° C. The thickness of the dried layer was 2 micrometers. Next ClGaPc photognerator layer was applied followed by drying 15 minutes at 125° C. Finally, a PCZ polycarbonate—TPD charge transport layer was coated on top at 25 micrometers from chlorobenzene (20%) and THF. Drying was carried out at 125° C. for 40 minutes. The resultant photoreceptors had the electrical properties summarized below. The CDS values were approximately 200 counts in A zone (80° F., 85% relative humidity).

| Sample | Vo | Q/A (PIDC) | Vdd/sec | dV/dx | Verase | Δ Erase | VL 15 ergs | Vdep |
|---|---|---|---|---|---|---|---|---|
| F-X 3 component control | 522 | 74 | 7 | 133 | 11 | 2 | 26 | 21 |
| 76 mol % PolyVBA-VBAc | 521 | 75 | 4 | 126 | 6 | 1 | 25 | 13 |
| 55 mol % PolyVBA-VBAc | 518 | 68 | 9 | 94 | 36 | 11 | 95 | 2 |
| 36.5 mol % PolyVBA-VBAc | 521 | 73 | 5 | 121 | 17 | 4 | 53 | 23 |

EXAMPLE 12

Slot Coated Samples. Poly(vinylbenzyl alcohol) (75.4 g in 702.4 g ethanol), gamma-aminotriethoxysilane (74.5 grams), and glacial acetic acid (22.6 g) were stirred for 16 hours and the resultant Brookfield viscosity was 25 cps. This solution was used to slot coat 3 micrometer undercoat layers on metallized Mylar. These undercoats were used to overcoat the following photogenerator dispersions: hydroxygallium phthalocyanine in polystyrene-block-polyvinylpyridine and toluene, chlorogallium phthalocyanine in VMCH (86% by weight vinyl chloride, 13% by weight vinyl acetate, and 1% by weight maleic acid where the VMCH has a molecular weight of about 27,000) and butyl acetate, benzimidazole perylene in PCZ polycarbonate in tetrahydroturan, and trigonal selenium in polyvinylcarbazole and cyclohexanone. The photogenerator layer was then overcoated with charge transport layer and scanned as previously described. The electrical properties of the resultant photoreceptors are summarized in the following tables. The designation S.C. indicates a slot coated undercoat layer.

| Sample/Description | Vo | Vdd/sec | S | Vr | Vdepl | Vcycle-up | VI3.8 | E1/2 | qV20μC |
|---|---|---|---|---|---|---|---|---|---|
| 12A: S.C. Poly(VBA)/HOGaPc/CTL | 798 | 124 | 311 | 10 | 32 | −27 | 52 | 1.36 | 925 |
| 12B: S.C. Poly(VBA)/HOGaPc/CTL | 796 | 102 | 284 | 9 | 23 | −0.8 | 53 | 1.48 | 900 |
| 12C: γAPS/49K/HOGaPc/CTL | 796 | 78 | 273 | 32 | 38 | −4.4 | 88 | 1.56 | 850 |
| 12D: γAPS/49K/HOGaPc/CTL-control | 798 | 114 | 282 | 4 | 3 | −3 | 52 | 1.49 | 750 |
| 12E: HOGaPcBGL/CTL-control | 799 | 62 | 331 | 1.4 | 40 | −29 | 59 | 1.28 | 1100 |
| 12F: Control | 799 | 275 | 306 | 1.2 | −75 | −21 | 16 | 1.33 | 750 |
| Handcoated Control γAPS Average | 798 | 98 | 309 | 20 | 26 | −0.1 | 66 | 1.39 | 864 |
| 12G: γAPS/49K/ClGaPc/CTL | 806 | 232 | 229 | −48 | −252 | −96 | 284 | 2.62 | 925 |
| 12H: γAPS/49K/ClGaPc/CTL | 791 | 230 | 139 | −7.2 | −420 | −51 | 417 | 4.09 | 900 |
| 12I: S.C. Poly(VBA)/49K/ClGaPc/CTL | 796 | 218 | 243 | −31 | −409 | −20 | 251 | 2.38 | 950 |
| 12J: S.C. Poly(VBA)/49K/ClGaPc/CTL | 792 | 230 | 248 | −27 | −428 | 1.4 | 249 | 2.36 | 1000 |
| 12K: γAPS/49K/BZP/CTL-control | 800 | 31 | 146 | −287 | 125 | 2.2 | 530 | 6.17 | 1050 |
| 12L: γAPS/IFL/49K/BZP/CTL-control | 793 | 40 | 107 | −52 | 34 | −27 | 448 | 4.44 | 1050 |
| 12M: BZP BGL/CTL-control | 789 | 115 | 109 | −11 | −203 | −2 | 421 | 4.10 | 950 |
| 12N: BZP Control | 791 | 109 | 102 | −37 | −175 | −16 | 445 | 4.39 | 800 |
| 120: S.C. Poly(VBA)/49K/BZP/CTL | 799 | 59 | 149 | −354 | 119 | −21 | 508 | 5.58 | 1000 |
| 12P: S.C. Poly(VBA)/49K/BZP/CTL | 802 | 66 | 115 | −175 | 174 | 5 | 494 | 5.18 | 1050 |
| 12Q: γAPS/49K/Trig Se/CTL-control | 814 | 93 | 980 | 91 | 108 | 18 | 372 | 3.17 | 1300 |
| 12R: γAPS/IFL/49K/Trig Se/CTL-control | 803 | 128 | 343 | 33 | 21 | 8 | 202 | 1.80 | 1300 |
| 12S: Trig Se BGL/CTL-control | 801 | 307 | 422 | 26 | −97 | 12 | 138 | 1.35 | 1100 |
| 12T: Trig Se Control | 793 | 301 | 473 | 18 | −419 | −35 | 96 | 1.11 | 900 |
| 12U: S.C. Poly(VBA)/49K/Trig Se/CTL | 803 | 160 | 327 | 36 | 59 | −30 | 225 | 1.96 | 1250 |
| 12V: S.C. Poly(VBA)/49K/Trig Se/CTL | 806 | 135 | 347 | 41 | 71 | −11 | 254 | 2.11 | 1200 |

EXAMPLE 13

Devices of Examples 1 and 12 were cycled continuously for 10,000 cycles in each of B (20° C., 40% Relative Humidity), A (26.6° C., 80% RH), C (15° C., 15% RH) and back again in B (20° C., 40% RH) zones. The final B zone results were the same as the initial B zone results demonstrating cyclic stability of the new undercoat layer.

EXAMPLE 14

Polyvinylbenzyl alcohol Binder for Titanium Dioxide Dispersions. A typical undercoat solution was made by adding 1 gram of poly(vinylbenzyl alcohol) to 9 grams of ethanol in a 60-milliliter amber bottle. Titanium dioxide powder (1 gram of spherical shaped titanium dioxide (MT500 or TA 300)) was added followed by 130 grams of stainless steel shot. After roll milling for 1 week, the stable dispersion was then coated on titanized polyethylene terephthalate film with a 1 mil gap Bird applicator. After heating 10 minutes at 135° C., the dried film thickness was approximately 2 micrometers. A 49,000 adhesive layer was then applied as a 0.5 wt. % solids solution in methylene chloride using a 1-mil Bird applicator. The resultant film was dried for 3 minutes at 135° C. To this layer was applied a photogenerator layer consisting of 40 wt. % solids toluene dispersion of hydroxygallium phthalocyanine with a 11,000 molecular weight binder polymer consisting of polystyrene-block-polyvinylpyridine. The dispersion was made by roll-milling 1.33 grams of hydroxygallium phthalocyanine with 1.5 grams of the block copolymer at 7% solids in toluene for 24 hours with steel shot. The dispersion was then diluted to 4% solids with toluene and applied using a 0.5 mil gap Bird applicator. The binder-photogenerator layer was then oven dried at 135° C. for 5 minutes. A charge transport layer solution was made by dissolving TPD (N,N'-diphenyl-N,N'-bis(methylphenyl)-1,1-biphenyl-4,4'-diamine, 1.2 parts) in Makrolon polycarbonate (1.2 parts) in 13.45 parts of methylene chloride. This solution was then applied using an 8 mil gap Bird applicator and the layer was oven dried by ramping the temperature from 40° C. to 100° C. over 30 minutes. The resultant dried charge transport layer film was 25 micrometers. The electrical properties of the resultant photoreceptors are summarized in the following table.

| Sample/Description | Vo | Vdd/sec | S | Vr | Vdepl | Vcycle-up | VI3.8 | E1/2 |
|---|---|---|---|---|---|---|---|---|
| 14A: Poly(VBA) + TiO2(MT500)/49K/HOGaPc/CTL | 797 | 99 | 370 | 7 | −17 | −3 | 38 | 1.15 |
| 148: Poly(VBA) + TiO2(TA300)/49K/HOGaPc/CTL | 794 | 298 | 350 | 123 | 179 | −30 | 140 | 1.21 |
| 14C: Poly(VBA) + TiO2(ST60)/49K/HOGaPc/CTL | 798 | 94 | 238 | 44 | 47 | 3 | 163 | 1.9 |
| 14D: γAPS/49K/HOGaPc/CTL-control | 800 | 64 | 367 | −5 | −7 | −0.3 | 21 | 1.15 |

Other modifications of the present invention may occur to those skilled in the art based upon a reading of the present disclosure and these modifications are intended to be included within the scope of the present invention.

We claim:

1. A photoreceptor including:

(a) a substrate;

(b) a charge blocking layer comprising a polymer polymerized from at least one monomer including vinylbenzyl alcohol monomer; and (c) a photoreceptor imaging layer.

2. The photoreceptor of claim 1, wherein the polymer is poly(vinylbenzyl alcohol).

3. The photoreceptor of claim 1, wherein the polymer is a copolymer.

4. The photoreceptor of claim 1, wherein the polymer is poly(vinylbenzyl alcohol-vinylbenzyl acetate).

5. The photoreceptor of claim 1, wherein the polymer is present in an amount of 100% by weight of the blocking layer.

6. The photoreceptor of claim 1, wherein the blocking layer further includes a silane.

7. The photoreceptor of claim 1, wherein the blocking layer further includes an alkyltrialkoxysilane.

8. The photoreceptor of claim 7, wherein the alkyl group of the alkyltrialkoxysilane contains from 1 to 25 carbon atoms.

9. The photoreceptor of claim 7, wherein the alkoxy group of the alkyltrialkoxysilane contains from 1 to 25 carbon atoms.

10. The photoreceptor of claim 7, wherein the alkyltrialkoxysilane is aminopropyltrimethoxysilane or gamma-aminopropyltriethoxysilane.

11. The photoreceptor of claim 1, wherein the blocking layer includes a n-type semiconductive material.

12. The photoreceptor of claim 11, wherein the n-type semiconductive material is titanium dioxide or zinc oxide.

13. The photoreceptor of claim 1, wherein the photoreceptor imaging layer is a charge generating layer and wherein the photoreceptor further comprises a charge transport layer.

14. The photoreceptor of claim 1, wherein the blocking layer has a thickness ranging from about 1 to about 5 micrometers.

* * * * *